United States Patent [19]

Farrington

[11] 4,314,430

[45] Feb. 9, 1982

[54] CORE BUILDING SYSTEM

[76] Inventor: Albert J. Farrington, Phelps St. R.D. 1, Gloversville, N.Y. 12078

[21] Appl. No.: 38,933

[22] Filed: May 14, 1979

[51] Int. Cl.[3] ..... E04B 1/16

[52] U.S. Cl. ..... 52/206; 52/309.12; 52/378; 52/741

[58] Field of Search ..... 52/741, 443, 309.12, 52/378, 363, 348, 364, 206, 601, 241, 243; 249/33, 39; 264/33, 35

[56] References Cited

U.S. PATENT DOCUMENTS

| | | | |
|---|---|---|---|
| 1,134,736 | 4/1915 | Gleason | 52/241 |
| 2,969,619 | 1/1961 | Didrick | 52/601 |
| 3,394,523 | 7/1968 | Sackett | 52/601 |
| 3,676,973 | 7/1972 | Kellert | 52/601 |
| 3,772,844 | 11/1973 | Thorne | 52/741 |

*Primary Examiner*—John E. Murtagh

[57] ABSTRACT

An improved method of wall construction, and an improved wall construction are provided by the invention. The individual components of the wall are first set in place and then encased in concrete to form a load bearing wall. Multiple channel track units are positioned at the upper and lower edges of the wall, extending therebetween is a plurality of non-load bearing uprights. Attached to the uprights are the various wall components such as doorframes, insulation windowframes, wiring and piping conduits. Forms are then set into place and the concrete is poured, upon hardening of the concrete the load bearing wall is complete, thereby eliminating customary furring strips, inside insulation, sheetrock, and external siding, plastering, stucco, etc.

6 Claims, 6 Drawing Figures

CORE BUILDING SYSTEM

BACKGROUND AND SUMMARY OF THE INVENTION

This invention relates generally to an improved method for constructing a load bearing wall and the wall itself. The invention is especially directed to a wall construction that allows the wall to be poured in place in an economical manner by relatively unskilled labor. While a number of different methods and constructions have in the past been provided for producing a load bearing wall, such constructions have generally required special tools, forms and the use of skilled labor. These constructions have therefore been relatively expensive in comparison to other forms of construction. The instant invention is directed to a method of wall construction and the wall itself which overcomes these limitations.

Generally speaking, in accordance with the invention, a method of constructing a cast load bearing wall and the wall itself are provided. The method produces a wall that is cast in place from concrete. The cast concrete wall includes integral insulation, windowframes, doorframes, and conduits for wiring or piping. The invention utilizes multiple channel tracks at the top and bottom with upright channels placed therebetween. Attached to the upright channels are the door and window frames and the various components contained within the wall. The uprights and upper and lower tracks support a centrally located layer of insulation. After the various components within the wall are in place, forms are set along each side of the wall and the concrete is poured into place. After the concrete hardens, the wall is a finished load-bearing wall.

Accordingly, it is an object of the invention to provide an improved method for, and an improved wall construction.

It is a further object of this invention to provide an improved method for, and an improved wall construction that is economical.

It is a further object of this invention to provide an improved method for, and an improved wall construction that can be erected utilizing relatively unskilled labor.

It is a further object of this invention to provide an improved method for, and an improved wall construction that can be erected relatively quickly.

It is a further object of this invention to provide an improved method for and an improved wall construction that provides a finished wall after the pouring of the concrete containing the necessary door and window frames, as well as conduits for wiring, piping, and insulation.

Still other objects will become apparent upon a reading of the detailed specifications to follow.

BRIEF DESCRIPTION OF THE DRAWINGS

In order to better understand the invention, reference is made to the following drawings taken in connection with the detailed specification to follow.

DESCRIPTION OF THE PREFERRED EMBODIMENT

Figure 1:
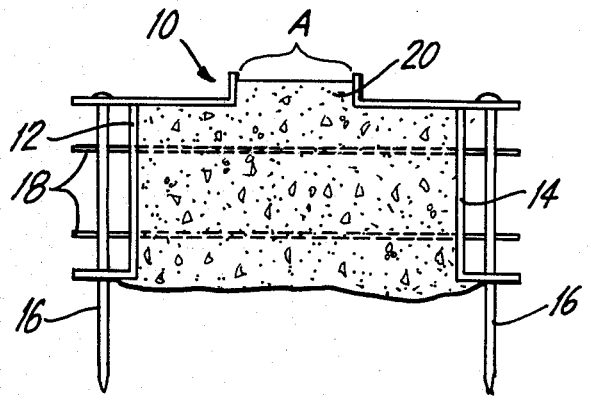
FIG. 1 illustrates the footings used in the construction of the invention.

The drawings illustrate the improved method of construction of an insulated, load-bearing wall and the improved wall itself. FIG. 1 illustrates the footing 10 upon which the load-bearing walls will be formed and poured. After normal excavation, as the type of building requires, inner 12 and outer 14 forms are laid out following the periphery of the building's load-bearing walls. Forms 12, 14 are anchored to the ground by rods 16 and are held together by snap ties 18 to contain the concrete as it is poured. The upper surface of footing 10 includes an upraised shoulder 20 whose width A will be the same as the load-bearing walls to be formed. The upraised shoulder 20 serves to align the forms for the load-bearing walls, since these forms may be set abutting its periphery. The footing is formed from poured concrete which includes any necessary reinforcement.

Figure 2:
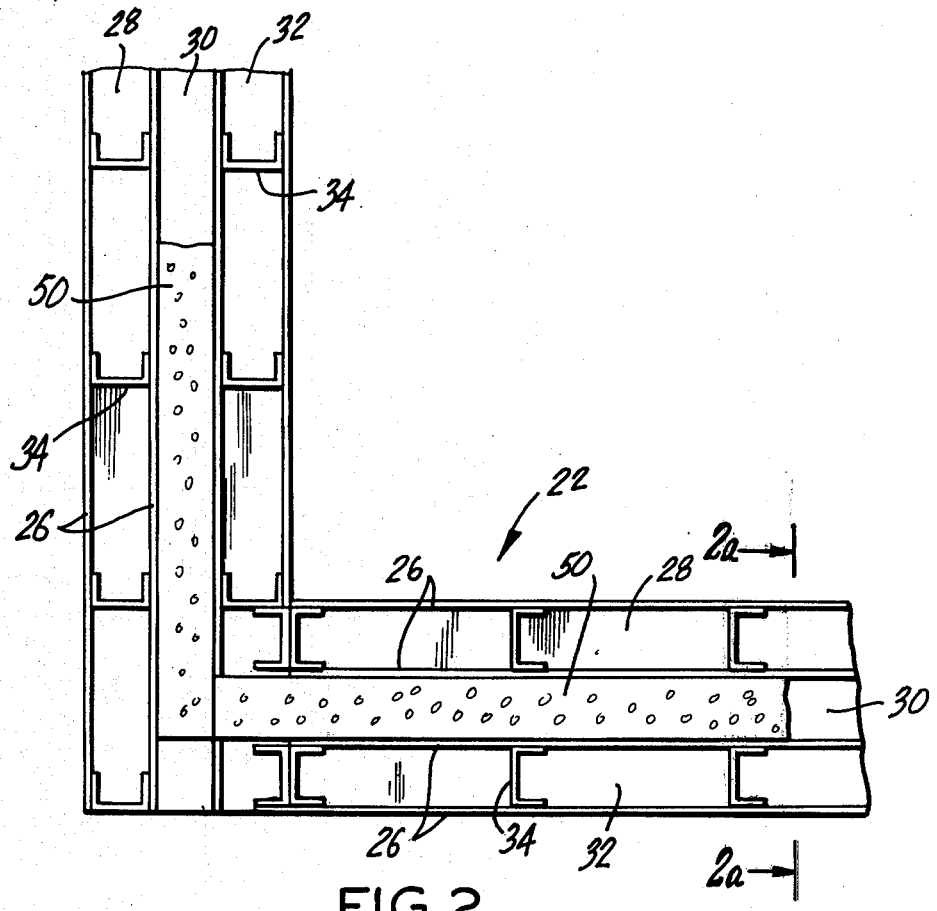
FIGS. 2 and 2*a* illustrate the track means used in the present construction.
Figure 2A:
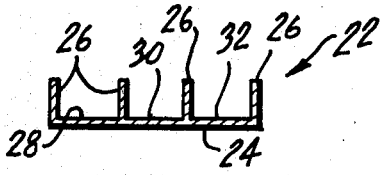

After the footings have been cast into place, the system of metal tracks and uprights are attached thereto and which in turn become integral parts of the load-bearing walls. Attached to shoulder 20 is a lower track unit 22 which includes a horizontal lower wall 24 and four upstanding walls 26 to thereby form three channels 28, 30, 32. Upright 34 in the form of vertical, non-load bearing metal studs are inserted into inner channel 28 and outer channel 32 of track unit 22 leaving center channel 30 free. Track unit 22 and uprights 34 may be formed from relatively thin non-load bearing sheet metal such as metal channel and studs used in dry wall construction, since the concrete supports the load on the wall. The upper ends of uprights 34 are inserted into the outer channels of an upper track unit 36 which is in all respects identical to lower track unit 22. The number of uprights 34 used and their spacing accommodates the various windows, doors, other openings, and conduits required in the wall. Alternatively track units 22, 36 and uprights 34 may be preassembled before being attached to footings 10. The method of construction of each wall will be identical and so joined at the corners that the walls will be precisely integrated with the wall elements abutting as shown in FIG. 2.

Figure 3:
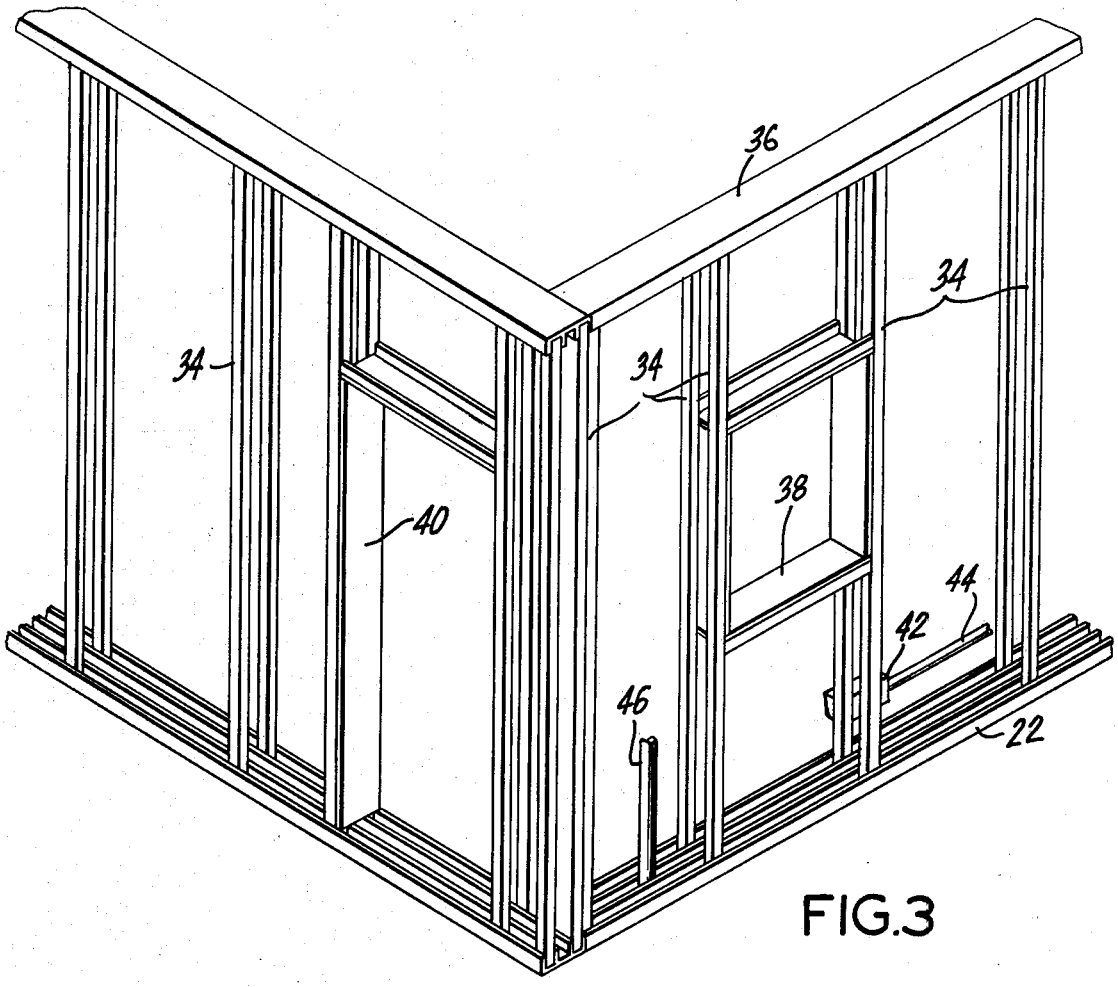
FIG. 3 illustrates the wall components before the pouring of the concrete.
Figure 4:
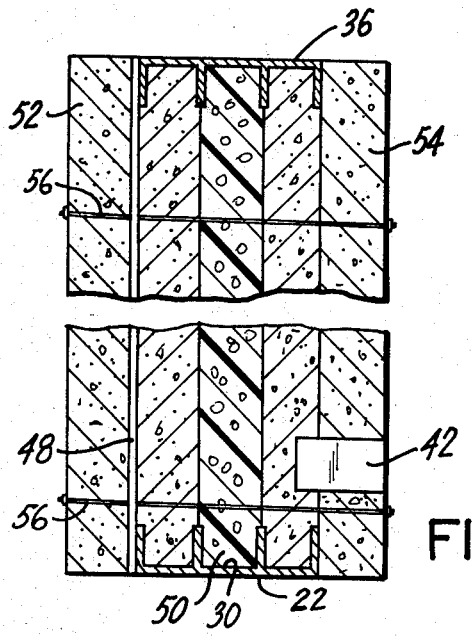
FIG. 4 is a cross-sectional view of the completed wall.
Figure 5:
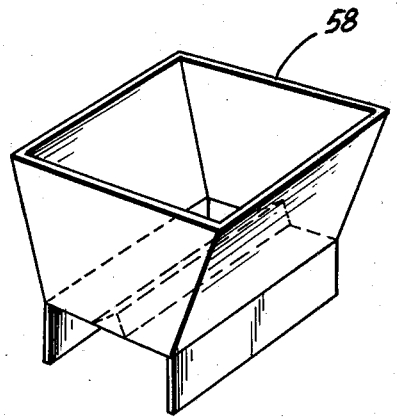
FIG. 5 shows the trough used to pour the concrete, as an optional method of placing the concrete.

As shown in FIG. 3., a window frame 38 and a door frame 40 are fastened between uprights 34. In order to simplify the concrete pouring operation it is desirable that window frame 38 have a hinged or removable lower ledge to permit the concrete to be poured thereunder. Also attached to uprights 34 are electrical outlet boxes 42, conduits 44 joining electrical boxes 42 are also set in place and wired to uprights 34. Water or sewer pipes 46 (or sleeves for the same) are then put in place and secured to uprights 34. Reinforcing wire 48 is then placed and secured to uprights 34. A sheet of foam insulation 50 is placed in the center channels 30 of the track systems. Furthermore, heating elements in a central heating system may also be placed within the wall sections and attached to uprights 34.

After all the components that are to be set within the walls are in place, the concrete which forms the load bearing wall is poured. Forms 52, 54 are set unto the shoulder formed at the edges of shoulder 20 of footings 10. These forms are secured together with appropriate snap ties 56. Spacer blocks (not shown) such as wood blocks, are used to maintain a spacing between uprights 34 and forms 52, 54 as the finished concrete wall will be wider than track units 22, 36 so that the concrete will form the outer and inner walls.

Utilizing a distribution box 58 or a concrete pump with a double nozzle or a hoisted tremie with twin, so called "elephant trunks", concrete is then pumped equally into the spaces on both sides of the insulation. The concrete should be pumped simultaneously onto both sides of the insulation because the pressure of the concrete on a single side may push the insulation out of place and impair the structural integrity of the wall. Alternatively the concrete may be poured on one side without the insulation in place, after the concrete has set the insulation is placed and the second side poured. The concrete may be pumped in sections at any suitable height, such as two foot sections, to simplify the operation. If pumped in sections, the forms are then moved up after the concrete has hardened and a second pour is commenced. Form liners can be used to give the finished concrete any desired architectural appearance such as brick or wood. In order to join the inner and outer concrete walls, horseshoe shaped reinforcement rods may be inserted into the concrete while still soft as the top of the wall is completed. Between sections an "H" shaped reinforcement rod will tie the inner and outer as well as the upper and lower walls together simultaneously.

It is clear that various thicknesses of wall can be accomplished by varying the size of the tracks, uprights and insulation. And the height of the wall is dependent upon the height of uprights 34 used. Particular dimensions found useful in building construction are two-inch uprights 34 mounted in track units 22, 36, six inches overall, having three two-inch channels. The concrete is then poured two inches on either side of the six inch tracks to form a wall of ten inch overall thickness. After each wall is completed the roof or upper floor may be added, and the entire process may be repeated so as to form a multiple story structure.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A method for the construction of a load-bearing wall comprising the steps of:

(a) positioning first track means along the lower edge of where said wall is to be placed, said first track means including first and second channel means;

(b) setting a plurality of upright means into said first and second channel means;

(c) positioning second track means about the upper edge of where said wall is to be placed, said second track means also including first and second channel means, said plurality of upright means extending between said first and second channel means of said first and second track means;

(d) positioning form means about said track means;

(e) pouring concrete between said forms, and;

(f) setting said concrete.

2. The method of construction as claimed in claim 1 further including the step of connecting at least one of door frame means and window frame means to said upright means before pouring said concrete.

3. The method of construction as claimed in claim 1 further including the step of connecting conduit means to said upright means before pouring said concrete.

4. The method of construction as claimed in claim 1 wherein said upper and lower track means include third channel means and further including the step of positioning insulation means in said third channel means before pouring said concrete.

5. The method of construction as claimed in claim 1 further including the step of positioning concrete reinforcing means between said upper and lower track means before pouring said concrete.

6. The load bearing wall formed by the method as claimed in claim 1.

* * * * *